United States Patent [19]

Graham et al.

[11] 4,018,282

[45] Apr. 19, 1977

[54] METHOD AND APPARATUS FOR GRAVEL PACKING WELLS

[75] Inventors: John W. Graham; William M. Salathiel; Clay Gruesbeck; Thomas W. Muecke, all of Houston, Tex.

[73] Assignee: Exxon Production Research Company, Houston, Tex.

[22] Filed: Feb. 26, 1976

[21] Appl. No.: 661,661

[52] U.S. Cl. ..... 166/278; 166/296; 166/302; 166/51; 166/227

[51] Int. Cl.[2] ..... E21B 43/04; E21B 43/08

[58] Field of Search ..... 166/296, 278, 276, 302, 166/227, 229, 205, 51

[56] References Cited

UNITED STATES PATENTS

| | | | |
|---|---|---|---|
| 3,216,497 | 11/1965 | Howard et al. | 166/296 X |
| 3,268,001 | 8/1966 | Brandt | 166/296 X |
| 3,273,641 | 9/1966 | Bourne | 166/296 X |
| 3,273,641 | 9/1966 | Bourne | 166/278 X |
| 3,277,962 | 10/1966 | Flickinger et al. | 166/296 X |
| 3,322,199 | 5/1967 | Van Note, Jr. | 166/296 X |
| 3,333,635 | 8/1967 | Crawford | 166/296 X |
| 3,880,233 | 4/1975 | Muecke | 166/296 |
| 3,905,423 | 9/1975 | Sparlin et al. | 166/296 |

*Primary Examiner*—Stephen J. Novosad
*Attorney, Agent, or Firm*—Salvatore J. Casamassima

[57] ABSTRACT

A perforated liner is sealed at longitudinally spaced intervals with a removable sealant. The partially sealed liner maintains sufficiently high fluid flow velocity outside the liner during gravel packing so as to prevent the formation of gravel dunes. After packing is completed, the sealant is removed permitting the passage of fluids through the liner.

29 Claims, 3 Drawing Figures

METHOD AND APPARATUS FOR GRAVEL PACKING WELLS

BACKGROUND OF THE INVENTION

1. Field of the Invention

This invention relates to a method and apparatus for gravel packing wells. In one aspect it relates to an improved liner for use in a wellbore.

2. Description of the Prior Art

A major problem in completing wells in unconsolidated or loosely consolidated formations is sand control. Sand particles entrained in produced fluids can plug the flow channels of the formation and can cause severe erosion of well equipment such as liners, the producing string, valves and pumps. A well known sand control technique is gravel packing, whereby properly sized gravel is placed opposite the unconsolidated formation, forming a sand exclusion zone which filters out the sand particles entrained in the produced fluid.

A conventional gravel packing technique involves locating a perforated liner at a subsurface location in the well and thereafter placing gravel around the liner. Normally, a slurry of gravel suspended in a liquid carrier is pumped into the annular space between the formation wall and the liner. Ideally, as the suspension reaches the bottom of the annulus the gravel is compactly deposited in the annulus on the exterior of the liner and the liquid carrier withdraws through the liner perforations and back up the casing string. In this manner, the gravel uniformly builds up until the entire annulus surrounding the liner is filled.

A problem encountered with this technique arises when the wellbore deviates from the vertical. When the well is inclined, the gravel fails to pack uniformly, resulting in voids within the packed annulus which weaken the pack and permit the production of sand entrained fluids. It is believed that the main reason for the occurrence of this problem is that the gravitational forces in such wells tend to cause the gravel to prematurely settle out near the upper end of the liner. As a result, a small gravel bank, referred to herein as a dune, begins to form within the upper end of the annulus. As the dune grows and descends down the annulus, more and more of the carrier liquid is diverted through the liner upstream of the dune thereby causing the velocity of the gravel suspension to decline. As velocity drops, the carrier liquid can no longer suspend the gravel in suspension with the result that additional gravel settles out until the dune completely blocks flow to the lower portions of the annulus. Substantially all of the carrier liquid is then diverted into the upstream section of the liner, causing the upper section of the annulus to pack while leaving a substantial void space in the lower section. In practice, a number of gravel dunes and void spaces may be formed in the manner described above.

In order to uniformly and compactly fill the annulus surrounding a liner in an inclined wellbore, the upper flow channel must remain open until the lower section of the annulus is filled. In efforts to achieve this, a conventional approach involves the use of a small diameter tube, known as a stinger, positioned through the liner, which serves as the return conduit for the carrier liquid. The carrier liquid must flow down to the bottom of the liner before passing back up through the stinger. This downward directional flow tends to force the gravel suspension to the bottom of the wellbore annulus. Stinger performance, however, is generally poor in inclined wellbores, especially when the liner is long or when the wellbore incline is steep.

As described by Maly and Robinson in U.S. Pat. No. 3,637,010, an improvement on the stinger is the baffled stinger. Deformably radial baffles are mounted on the stinger along its length and are sized so as to provide several longitudinally spaced seals between the stinger and the liner. The baffles, positioned in this manner, prevent carrier liquid from flowing into the upper portions of the liner, thereby forcing all liquid suspension down the annulus to the base of the liner. A sufficiently high flow velocity of the gravel suspension within the annulus is maintained to prevent the formation of dunes. As the annulus fills with gravel, the carrier liquid is diverted through the liner perforations until the gravel within the annulus builds up past a baffle. At this point the differential pressure across the baffle increases sufficiently to deform the baffle causing it to be downwardly cupped, thus opening a flow passage to the bottom of the stinger and allowing liquid to flow past the baffle. Baffled stingers, however, introduce other problems. The mounted baffles are costly, they impede free movement or rotation of the stinger, and they are not universally effective in arresting dune formation, especially in wells inclined at steep angles.

SUMMARY OF THE INVENTION

The problem of dune formation in inclined wells is substantially eliminated by the present invention. In accordance with the invention, a perforated liner is provided with a sealant to substantially reduce the flow area of the liner. Tests have shown that the partially sealed liner permits an inclined wellbore to be uniformly and compactly filled with gravel. The material sealing the liner is then removed, permitting free flow of produced fluids.

The sealant is preferably applied to the liner at separated segments along the length of the liner, thus leaving exposed a series of intermittently spaced unsealed sections. The sealed intervals keep the gravel suspension flowing in the wellbore annulus, thereby maintaining flow velocity, while the unsealed sections permit a small stream of the carrier liquid to enter the liner. As the annulus fills with gravel, thus covering the lower portions of the liner, carrier liquid will begin entering the liner through progressively higher unsealed sections until the annulus outside the liner is completely packed.

Once the gravel is placed and the carrier liquid withdrawn, the sealant is then removed. Removal of the sealant may be achieved by several mechanisms including melting of a fusible heat-sensitive sealant and the chemical decomposition or solvent extraction of a dissolvable sealant. Removal of the sealant will open all of the liner perforations, permitting free flow of produced fluids into the liner.

A preferable sealant is a fusible, heat sensitive material. Such a sealant could be melted by the heat generated by the producing formation if the melting point of the sealant is below the normal temperature of the formation. Alternatively, a fusible sealant can be melted by injecting hot liquids or vapors into the liner. Although a variety of materials such as thermoplastic resins, low melting alloys and the like can be used, the preferred heat-sensitive sealant is paraffin wax. A suitably selected sealant could also be removed by other methods such as solvent extraction or chemical decomposition.

DESCRIPTION OF THE PREFERRED EMBODIMENT

Figure 1:
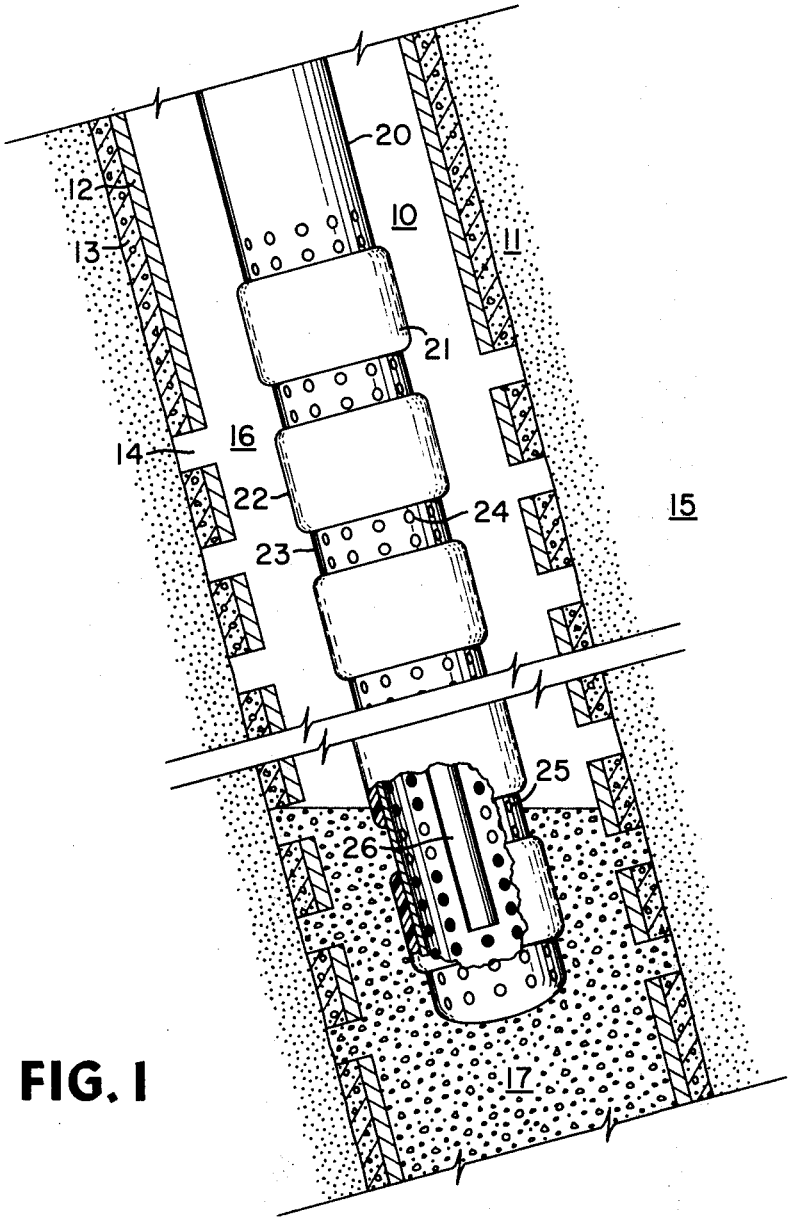
FIG. 1 is a schematic of a liner after it has been partially coated with a sealant and lowered into a wellbore.

With reference to FIG. 1, an inclined wellbore 10 penetrates a subterranean producing formation 11. Well casing 12 which extends through the well and is held in place by cement 13 is provided with perforations 14 in the producing zone 15. A lower portion of wellbore 10 may be enlarged in the perforated interval to provide a larger borehole in the producing zone 15 to be gravel packed.

Perforated liner 20 is placed in the wellbore 10 opposite producing zone 15. An annular space 16 defined by the liner 20 and casing 12 is the area which is to be packed with gravel. For purposes of the present discussion, the terms "liner" or "perforated liner" as used herein refer to a wide range of tubular subsurface devices used in wells. Such devices are referred to in the art as "pre-perforated liners", "vertically slotted liners", "horizontally slotted liners", "screens", "prepacked screens", "wire wrapped screens" and the like. The term "gravel" as used herein refers to any granular or aggregate material used for filtering purposes in subsurface wells.

In accordance with the present invention, the liner 20 is partially covered with a heat sensitive paraffin wax sealant coating 21 in the preferred seal configuration illustrated by FIG. 1. The coating is applied in broad intervals 22 spaced along the length of the liner 20 leaving unsealed narrow bands 23. The coating should be applied so that the unsealed bands 23 are spaced apart at approximately equal intervals. A preferred arrangement has sealed intervals of about 1 to 3 feet in the axial width dimension of the liner, evenly spaced apart by unsealed bands of about 4 to 8 inches in width. The unsealed bands thus leave exposed about 3 to 40 percent of the liner's perforations 24.

The gravel may be deposited in annular space 16 using a conventional inside gravel packing technique. However, it should be noted that this method applies equally well to open hole gravel packs. The liner 20 is lowered into the wellbore 10 on the well tubing string (not shown) which normally includes a crossover tool (not shown). Gravel and a carrier liquid, normally water, are mixed to form a gravel suspension which is then pumped through the tubing, crossing over to the outside of liner 20. The gravel 17 is deposited within the annular space 16. Carrier liquid enters liner 20 through the lowest open unsealed perforations 25 (i.e., those perforations not surrounded by packed gravel 17). Carrier liquid then flows down the inside of liner 20 and into lower end of tube 26, located within the liner, and from there to the surface. Sufficient gravel is deposited in this manner until the entire liner 20 is packed. The gravel suspension maintains the temperature of the liner substantially below the temperature of the earth formation 11. However, once gravel placement has been completed the wellbore temperature approaches that of the formation 11 causing the wax sealant coating 21 to melt thereby opening the remaining liner perforations. Produced fluids can then flow freely from the producing zone 15 through the gravel 17 into liner 20.

Figure 2:
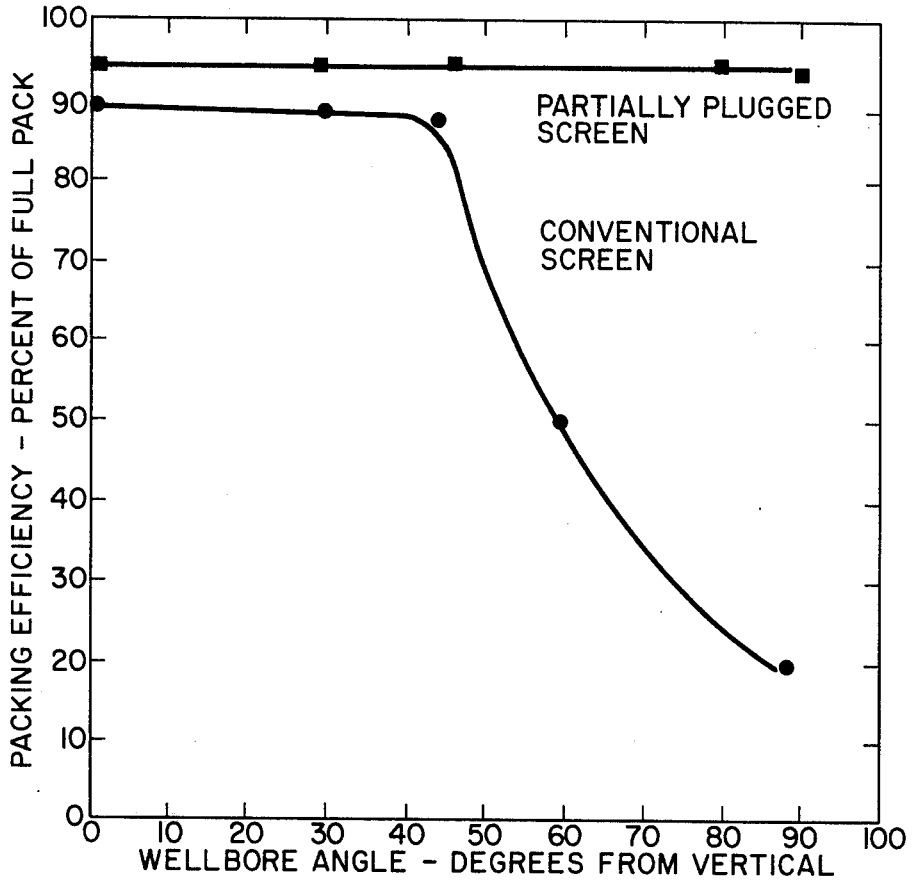
FIG. 2 is a plot of packing efficiency versus wellbore incline angle for a partially sealed and an unsealed liner.

Laboratory tests have shown that the invention, as described above, significantly improves gravel packing efficiency. This is demonstrated by FIG. 2, which compares packing efficiency obtained using an unsealed liner with packing efficiency obtained using a liner having 83% of its perforations sealed with wax. Experiments were conducted with a 3 inch diameter, 10 foot long liner with 2 inch wire wrapping. The partially sealed liner consisted of a series of 6 inch unsealed intervals followed by 2½ foot sealed intervals. Tests were performed using tap water at a gravel concentration of 0.5 lb/gal which was pumped at an initial annular velocity of 1 ft/sec through the liner-casing annulus. The partially sealed liner achieved about a 95% packing efficiency at all inclination angles and exhibited a much higher packing efficiency in highly deviated wells than the conventional liner. Surprisingly, the partially sealed liner also outperforms the conventional liner in vertical wells. The invention can thus be employed to increase gravel packing efficiency in both inclined and vertical wells.

As mentioned previously, the preferred sealant is a petroleum wax such as paraffin wax. Paraffin wax is inexpensive and is easily applied to the liner. Furthermore, a large variety of these waxes with a wide range of melting points (between about 85° and 190° F) are readily available. However, other types of waxes, such as vegetable, insect, animal and synthetic waxes can also be used. With the wide variety available, the wax needed for a particular formation temperature can almost always be found. However, if heat which is naturally generated by the formation is used to melt the wax then the melting point of the wax must be below the temperature of the formation but above that of the gravel suspension. The term "melting point" as used herein means the temperature at which the sealant either melts or softens sufficiently to flow from the liner perforations. Ideally, the wax selected should have a melting point about 10° F lower than the formation temperature.

Other sealants may also be employed. Thermosplatic resins which have comparatively high melting points can be used when high formation temperatures are encountered. However, if a relatively low temperature formation is encountered, then a low melting alloy, such as Woods' alloy, might be the suitable sealant.

The sealant need not be melted by heat generated by the formation. Hot gases or liquids, such as steam, can be injected into the liner to melt the sealant. The sealant could also be melted by electrical heating elements inserted in the liner. These techniques might be preferred if it is desirable to more closely control the time at which the sealant is melted. If these techniques are chosen, a sealant with a melting point above the normal temperature of the formation should be selected so that the sealant is prevented from melting prior to the injection of the hot fluid.

The sealant need not be a heat-sensitive material. In another embodiment of the invention, the sealant is removed by chemical means such as solvent extraction or acidic decomposition. For example, if a wax sealant is used, a solvent such as toluene or xylene can be pumped into the well to dissolve the wax once the gravel packing phase is completed.

Any number of techniques may be used for applying the sealant to the liner so as to plug or block the liner perforations. The sealant can be coated on or tightly wrapped around the outside of the liner or it can be placed on the inside surface of the liner. Also, the liner perforations alone can be plugged with the sealant by pressure injecting a pre-softened sealant into the perforations. A preferred coating technique involves selectively blocking off those areas of the liner which will be left unsealed. This is done by first wrapping tape around the selected areas and then dipping the liner into a vat of molten sealant, allowing the sealant to coat the entire liner, including the taped portions. Finally, the tape is removed (along with the sealant coating the tape) leaving a liner coated in segments with unsealed sections in between the coated segments.

Figure 3:
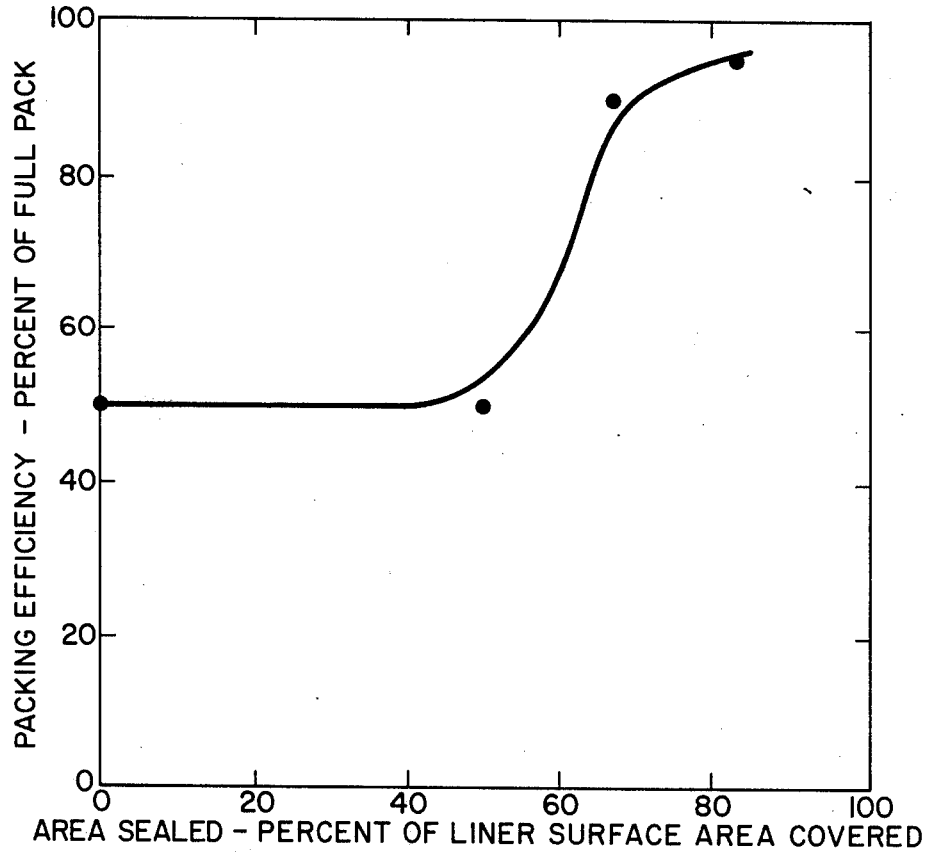
FIG. 3 is a plot of packing efficiency versus fraction of coverage of liner surface area at a wellbore incline of 60 degrees from the vertical.

A novel feature of the invention is to partially plug the liner perforations with sealant. Restricting flow of carrier liquid into the liner and diverting flow into unsealed areas maintains the high flow velocity in the wellbore annulus necessary to achieve a more compact and stable gravel pack. However, packing efficiency is also a function of the amount of liner surface area which is sealed. FIG. 3 shows a plot of packing efficiency versus percent surface area covered. A constant wellbore angle of 60° off the vertical was maintained at all times, and a liner of the type described in the preferred embodiment was used. The plot indicates the preferred range of operation is about 67 to about 83% area covered. This range will give a gravel packing efficiency of more than 90 percent. However, any partial coverage of the liner in excess of about 60% will significantly increase packing efficiency.

The geometric arrangement by which the liner is partially sealed is also important. The unsealed open areas should be intermittently spaced along the entire length of the liner. This will allow withdrawal of the carrier fluid at progressively higher levels along the liner as the well-bore annulus fills. A configuration for a partially sealed liner in which only the lower portion of the liner is open would be unacceptable because carrier fluid would have to exit from the lower portion of the lineer and as the annulus filled with gravel, covering this portion, the carrier fluid would be forced to pass through an increasingly thicker zone of packed gravel. With long liners, an unacceptably high pressure gradient within the gravel bed would have to be overcome. This problem is avoided by proper spacing of the open areas longitudinally along the entire length of the liner.

As indicated, the preferred configuration is to have sealed sections alternating with bands of unsealed sections. However, other designs can be employed. For example, instead of alternating sealed and open bands, one continuous band of sealant can coil the entire liner in a helical configuration. Such a design would maintain more stable pressure continuity during packing. Another embodiment is to place plugs or patches of sealant, in selected areas, on the liner.

The principle of the invention and various modifications and embodiments have been described. It should be realized that the foregoing is illustrative only and that other means and techniques can be employed without departing from the scope of the claimed invention.

We claim:

1. In a method of gravel packing a perforated liner opposite a subterranean formation in a well wherein a carrier liquid having gravel suspended therein is flowed downwardly along the outside of said liner to deposit said gravel around said liner, the improvement comprising:

restricting the flow of said carrier liquid into said liner so as to maintain the minimum flow velocity of said carrier liquid along the outside of said liner that is necessary to prevent the premature settling of said gravel and the formation of gravel dunes near the upper portions of said liner.

2. The method as recited in claim 1 wherein said well is inclined.

3. A method of gravel packing a liner opposite a subterranean formation in a well comprising:

partially sealing a perforated liner at longitudinally spaced intervals with a temporary sealant to substantially reduce the total flow area formed by the perforations of said liner;

placing said liner in said well;

downwardly flowing a carrier liquid having gravel suspended therein about the outer periphery of said liner to deposit said gravel around said liner, and sealed intervals maintaining sufficient flow velocity of said carrier liquid outside said liner to prevent said gravel from prematurely settling out and from forming gravel dunes near the upper portions of said liner, said carrier liquid returning by flowing through the unsealed perforations of said liner and back up said liner; and therefter removing said sealant.

4. The method as recited in claim 3 wherein said well is inclined.

5. The method as recited in claim 3 wherein said sealant is a fusible, heat-sensitive material with a melting point below the normal temperature of said formation where said liner is placed and wherein said sealant is removed by melting said sealant with formation heat.

6. The method as recited in claim 5 wherein said fusible material is wax.

7. The method as recited in claim 5 wherein said fusible material is a thermoplastic resin.

8. The method as recited in claim 5 wherein said fusible material is a low melting point alloy.

9. The method as recited in claim 3 wherein said sealant is a fusible, heat-sensitive material and wherein said sealant is removed by melting said sealant with a hot fluid injected into said liner.

10. The method as recited in claim 9 wherein said hot fluid is steam.

11. The method as recited in claim 9 wherein said fusible material is wax.

12. The method as recited in claim 9 wherein said fusible material is a thermoplastic resin.

13. The method as recited in claim 9 wherein said fusible material is a low melting point alloy.

14. The method as recited in claim 3 wherein said sealant is a dissolvable material and wherein said sealant is removed by extracting said sealant with a solvent.

15. The method as recited in claim 3 wherein said element is a decomposable material and wherein said sealant is removed by decomposing said sealant with a corrosive chemical.

16. The method as recited in claim 3 wherein the partial sealing of said liner reduces the total flow area by at least about 60 percent.

17. The method as recited in claim 16 wherein the flow area reduction is between about 67 and 83 percent.

18. In a method of gravel packing a perforated liner opposite a subterranean formation in a well wherein a carrier liquid having gravel suspended therein is flowed downwardly along the outside of said liner, said gravel being deposited around said liner, and said carrier liquid is then flowed through the perforations of said liner and upwardly through a return tube which extends substantially through the entire length of said liner, the improvement wherein said liner is provided with a plurality of temporary seals longitudinally spaced therealong to reduce the total flow area of said liner perforations and to thereby maintain sufficient flow velocity of said carrier liquid along the outside of said liner so that the premature settling of said gravel and the formation of gravel dunes near the upper portions of said liner is prevented, said temporary seal being fusible at the normal subsurface temperature of said formation.

19. Apparatus for gravel packing wells comprising:

a perforated liner; and a removable sealant placed on or in said liner to partially seal said liner, said liner having unsealed perforations substantially throughout its entire length, said sealant being located to selectively seal perforations distributed along said liner to reduce the total flow area of said perforations by at least about 60 percent and to restrict the flow of fluids into said liner.

20. Apparatus as defined in claim 19 wherein said sealant partially seals said liner at longitudinally spaced intervals.

21. Apparatus as defined in claim 19 wherein said sealant is a fusible, heat-sensitive material.

22. Apparatus as defined in claim 21 wherein said fusible material is wax.

23. Apparatus as defined in claim 21 wherein said fusible material is a thermoplastic resin.

24. Apparatus as defined in claim 21 wherein said fusible material is a low melting point alloy.

25. Apparatus as defined in claim 19 wherein said sealant is a solvent extactable material.

26. Apparatus as defined in claim 19 wherein said sealant is chemically decomposable material.

27. Apparatus as defined in claim 19 wherein between about 67 and 83 percent of said flow area is sealed.

28. Apparatus as defined in claim 19 wherein said sealant is placed so as to leave unsealed a plurality of narrow bands, said bands being evenly distributed along the length of said liner.

29. Apparatus for gravel packing wells comprising:

a perforated liner;

a removable sealant, said sealant partially sealing said liner at longitudinally spaced intervals to reduce the total flow area formed by the perforations of said liner so that the flow velocity about the outer periphery of said liner, of a carrier liquid having gravel suspended therein, is sufficiently maintained to prevent said gravel from prematurely settling out and forming gravel dunes near the upper portions of said liner; and a return tube which extends substantially through said liner and which is the return conduit for said carrier liquid.

* * * * *